US006162062A

United States Patent [19]

Liao

[11] Patent Number: 6,162,062

[45] Date of Patent: Dec. 19, 2000

[54] STRUCTURE OF TELEPHONE CONNECTOR

[76] Inventor: Sheng Hsin Liao, No. 137, San Chun St., Shu Lin Jen, Taipei Hsien, Taiwan

[21] Appl. No.: 09/225,337

[22] Filed: Jan. 5, 1999

[51] Int. Cl.[7] ..... H01R 13/00

[52] U.S. Cl. ..... 439/17

[58] Field of Search ..... 439/13, 17, 18, 439/19, 20, 21, 22, 27, 29, 676, 660, 344, 700, 824

[56] References Cited

U.S. PATENT DOCUMENTS 5,082,448 1/1992 Kang ..... 439/22

5,899,753 5/1999 Wong et al. ..... 439/17

*Primary Examiner*—Paula Bradley

*Assistant Examiner*—Alexander Gilman

*Attorney, Agent, or Firm*—Rosenberg, Klein & Lee

[57] ABSTRACT

An improvement of the structure of a telephone connector is disclosed. The connector is formed by engaging a rotary head with a fixing plug. The fixing plug is installed with a plurality of round disks with conductive rings of different radii and each conductive ring contacts with the contact terminal in the plug body. A plurality of through holes are installed within the rotary head. Each through hole is installed with a metal rolling ball, or a body formed by a metal roller ball, an engaging piece and a spring so to contact with the contact terminal within rotary head. Thereby, when the connector is assembled in the telephone receiver or the receptacle receiver so that the telephone cable causes the rotary head to rotate, by the low resisting friction of the rolling ball, not only the rotary head can rotate actively and smoothly with respect to the fixing plug so that the telephone cable will not be intricate, but also the conductive rings will not be destroyed or vibrate. Therefore, the equality of signal transformation is more steadily ad tolerable.

3 Claims, 6 Drawing Sheets

STRUCTURE OF TELEPHONE CONNECTOR

BACKGROUND OF THE INVENTION

1. Field of the Invention

The present invention relates to a connector, and particularly to a connector which can be installed on the receiver of a telephone or the receptacle of a mainframe in order to avoid intrication of the telephone cable, thus increasing the life time of the connector.

2. Prior Art

In general, a telephone cable intricates and thus it can be extended or compressed, so that a user can carry the receiver a predetermined distance away from the telephone. The receiver also intricates as it is used frequently, that effects the appearance of the receiver, and makes it inconvenient in use. The user thus has to waste time in order to arrange the telephone cable in order.

There are many connector designs which are disposed in the receptacles of a receiver and are capable of rotation along with the pulling of the telephone cable. For example, U.S. Pat. No. 5,082,448 discloses a telephone connector which includes a rotary head 1 and a fixing plug 2. A plurality of contact terminals 11 spaced each from the other are installed within the inserting holes 10 of the rotary head 1. A plurality of through holes 12 are formed on the bottom of the rotary head for receiving the connecting piece of a spring 13, so that one end of the spring 13 contacts with the respective contact terminal 11. The fixing plug 2 includes a plug body 20 and a round disk 21. A plurality of through holes 211 receive springs 210 therein. Each spring 210 contacts with a respective conductive ring 212. A plurality of contact terminals 200 are installed within the plug body 20 so that the round disk 21 can be fixed thereon, and thus another end of the spring 210 will contact with the respective contact terminal 200. After the fixing plug 2 is arranged within the rotary head 1, a C ring 202 will engage with the pad 201. This way, the assembly of the connector is completed, with the rotary head 1 in rotational engagement with respect to the fixing plug 2 when the fixing plug 2 of the connector is inserted into the receptacle of the receiver. At the side of the round disk 21 adjacent to the plug body 20, the respective contact terminal 200, spring 210, and the conductive ring 212 are electrically interconnected. However, at another side of the round disk 21 opposite to the plug body 20, the contact terminal 11, spring 13, and the conductive ring 212 electrically contact each with the other as the rotary head 1 is motionless. While when the rotary head 1 rotates, since the round track formed by the moving spring 13 coincides with the track of the respective conductive ring 212 thus forming a continuous dynamic contact therebetween. Therefore, when the plug of the telephone cable is inserted into the inserting hole 10 of the rotary head 1 for using the receiver, the pulling of the telephone cable will drive the rotary head to rotate. This way, the telephone cable will not intricate, and the communication will be retained continuously.

Disadvantageously, during the rotation of the rotary head 1, the distal end of the spring 13 contacts the respective conductive ring 212; and having a sharp edge, the end of the spring 13 produces large friction forces therebetween, thus negatively influencing traveling of the spring 13 along the surface of the conductive ring 212. Thus, the rotation of the rotary head with respect to the fixing plug 2 is hard. With the increase of the friction force, the surface of the conductive ring is easily worn by the spring 13. Moreover, the excessive friction may cause vibration of the spring 13, which destroys the quality of the communication signal. The spring 13 itself may be distorted and buckled within the through hole 12, thus even further destroying the quality of the communication.

SUMMARY OF THE INVENTION

Accordingly, the object of the present invention is to provide an improvement of the structure of a telephone connector. The subject connector is formed by rotationally engaging a rotary head with a fixing plug. Connecting pieces are installed within the through holes of the rotary head of the connector. The connecting piece is a metal rolling ball, or a body formed by a metal roller ball, an engaging piece and a spring which is brought into contact with the contact terminal within the rotary head. Thereby, when the connector is assembled and input in the receptacle of the telephone receiver, the telephone cable causes the rotary head to rotate. Due to the low resisting friction between the rolling ball and the surface of the conductive rings, not only the rotary head can rotate actively and smoothly with respect to the fixing plug so that the telephone cable will not intricate, but also the conductive rings will not be worn. Also, any unwanted vibration is avoided, so that the signal transformation quality is satisfactory.

The present invention will be better understood and its numerous objects and advantages will become apparent to those skilled in the art by referencing to the following drawings in which:

DETAILED DESCRIPTION OF THE PREFERRED EMBODIMENT

Figure 1:
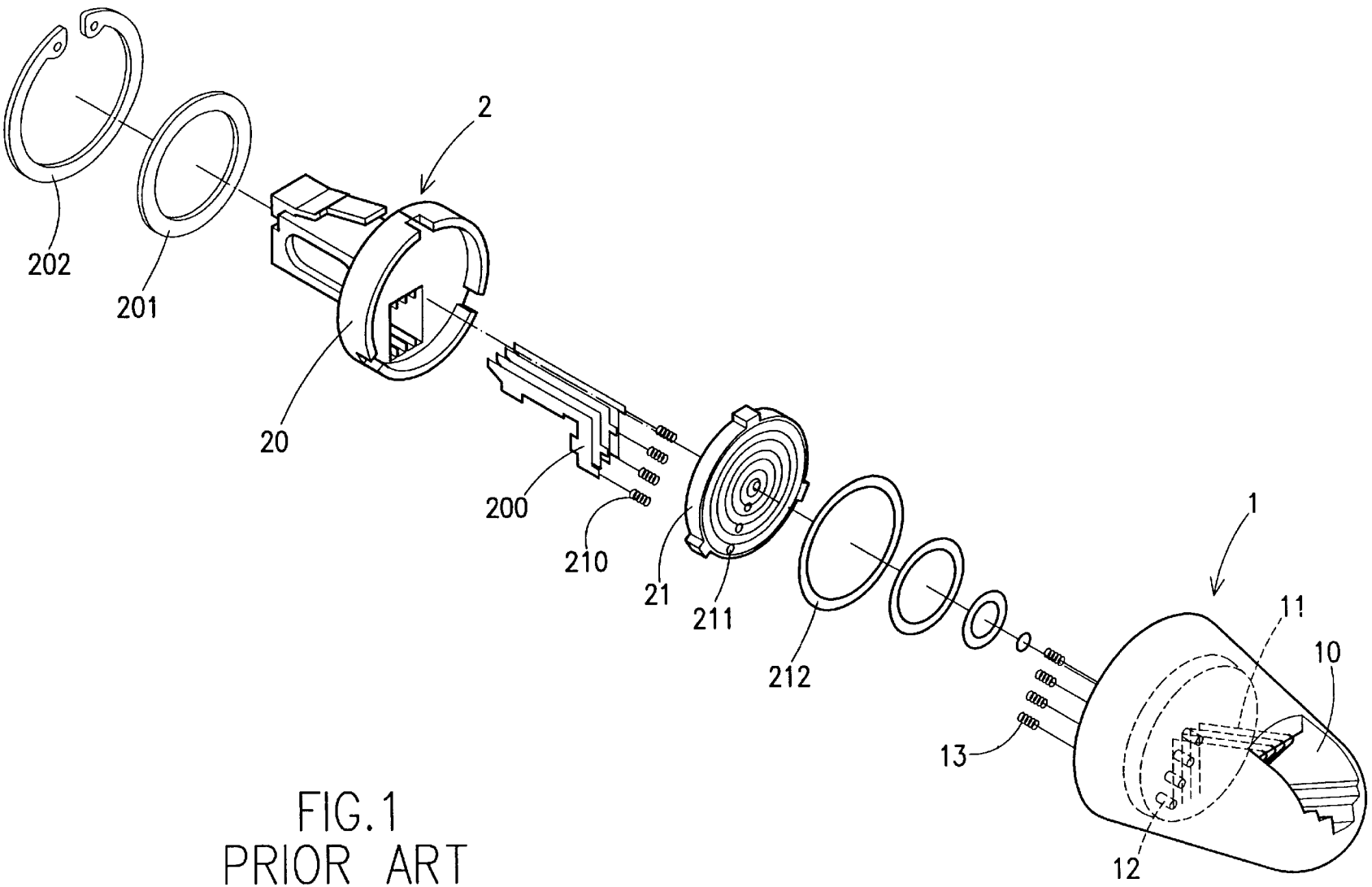
FIG. 1 PRIOR ART
FIG. 1 is an exploded perspective view of the structure of a telephone connector of the prior art.
Figure 2:
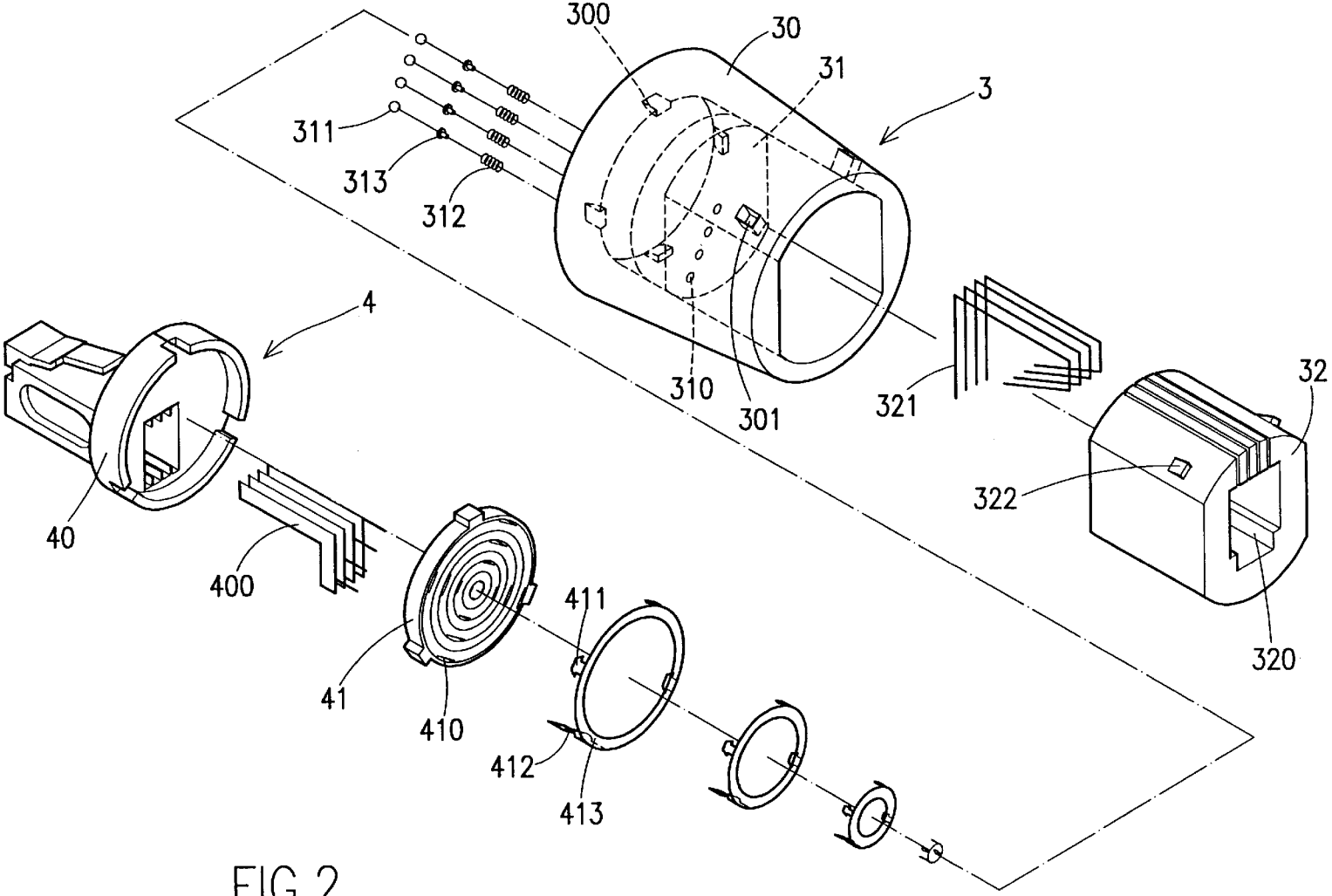
FIG. 2 is the exploded perspective view of an improvement of the structure of a telephone connector of the present invention.
Figure 3:
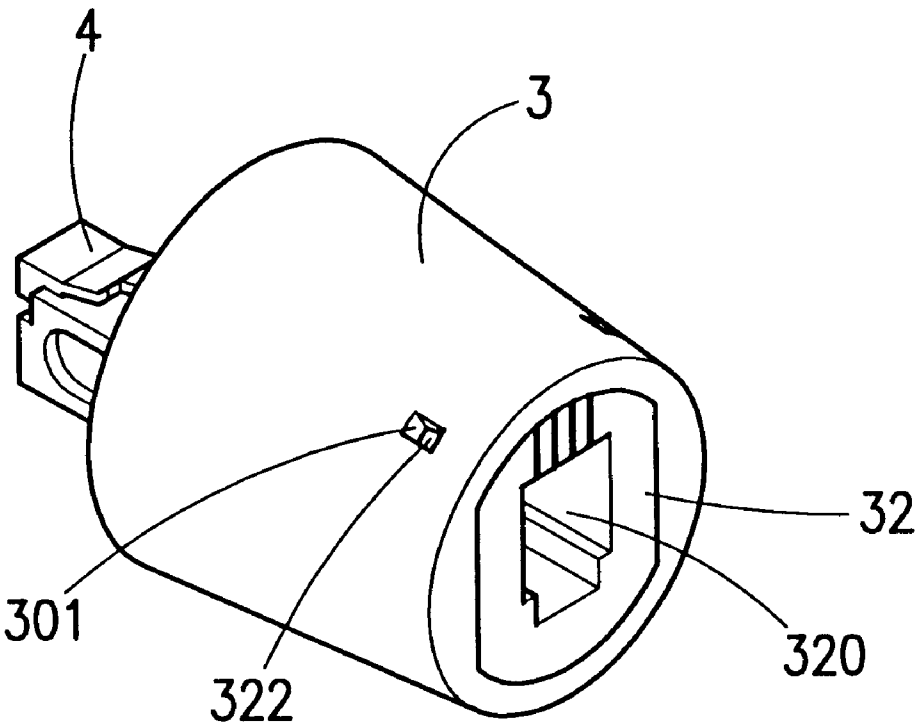
FIG. 3 is a perspective view of the assembled structure of the present invention.

Referring now to FIGS. 2 and 3, the improvement of the structure of a telephone connector according to the present invention includes a rotary head 3 and a fixing plug 4.

The rotary head 3 comprises a roller 30, a rotary disk 31 and a plug 32. The roller 30 is a hollow cylinder. A stopper 300 is formed at the inner rim of the roller 30, and a buckling hole 301 is made in a proper place on the inner wall of the roller 30. The rotary disk 31 is tightly forced toward the opening of the roller 30 opposite to the stopper 300. Alternatively, the rotary disk 31 is integrally formed in the roller 30. Through holes 310 are formed on the different elevations of the rotary disk 31. Each of the through hole 310 receives a connecting piece therein, which includes a metal rolling ball 311 assembled with a spring 312 and an engaging piece 313. The engaging piece 313 has a positioning pin and a plane. The engaging piece 313 is inserted into the end portion of the spring 312 by the positioning pin 314 to be positioned therewithin and then the engaging piece 313 can point-contact with the rolling balls 311 by the plane thereof.

The plug 32 is fixed to the roller 30 by the buckling block 322 to buckle to the buckling hole 301. A plurality of contact terminals 321 are fixed on the plug 32. One end of each terminal 321 is adhered to one end of the through hole 310 to contact with the rolling balls 311 or the spring 312. Another end of the terminal 321 is inserted into the inserting hole 320 of the plug 32 for contact with the plug of a telephone cable.

The fixing plug 4 is formed by connecting a plug body 40 and a round disk 41, which is removably received into the roller 30 and is confined therein by the stopper 300 in order to be held in place. Thus, the fixing plug 4 can rotate with respect to the roller 30. The round disk 41 has a plurality of inserting holes 410 each positioned a predetermined distance from the center of the round disk 41. Each conductive ring 413 has elastic pieces 412 formed integrally thereon and inserting pieces 411. Each of the conductive ring 413 can be installed on the round disk 41 by the inserting piece 411 and the elastic piece 412 inserted into respective inserting holes 410, the position of which on the round disk 41 corresponds to a diameter of the conductive ring 413. This way, the surface of the conductive ring 413 can dynamically contact with the rolling balls 311 of the rotary disk 31. A plurality of contacting terminals 400 which are positioned in parallel relationship each with respect to the other are installed within the plug body 40 so that the respective elastic piece 412 of the conductive ring 413 of the round disk 41 can pass through the inserting hole 410 to electrically contact with one end of the contact terminal 400.

Figure 4:
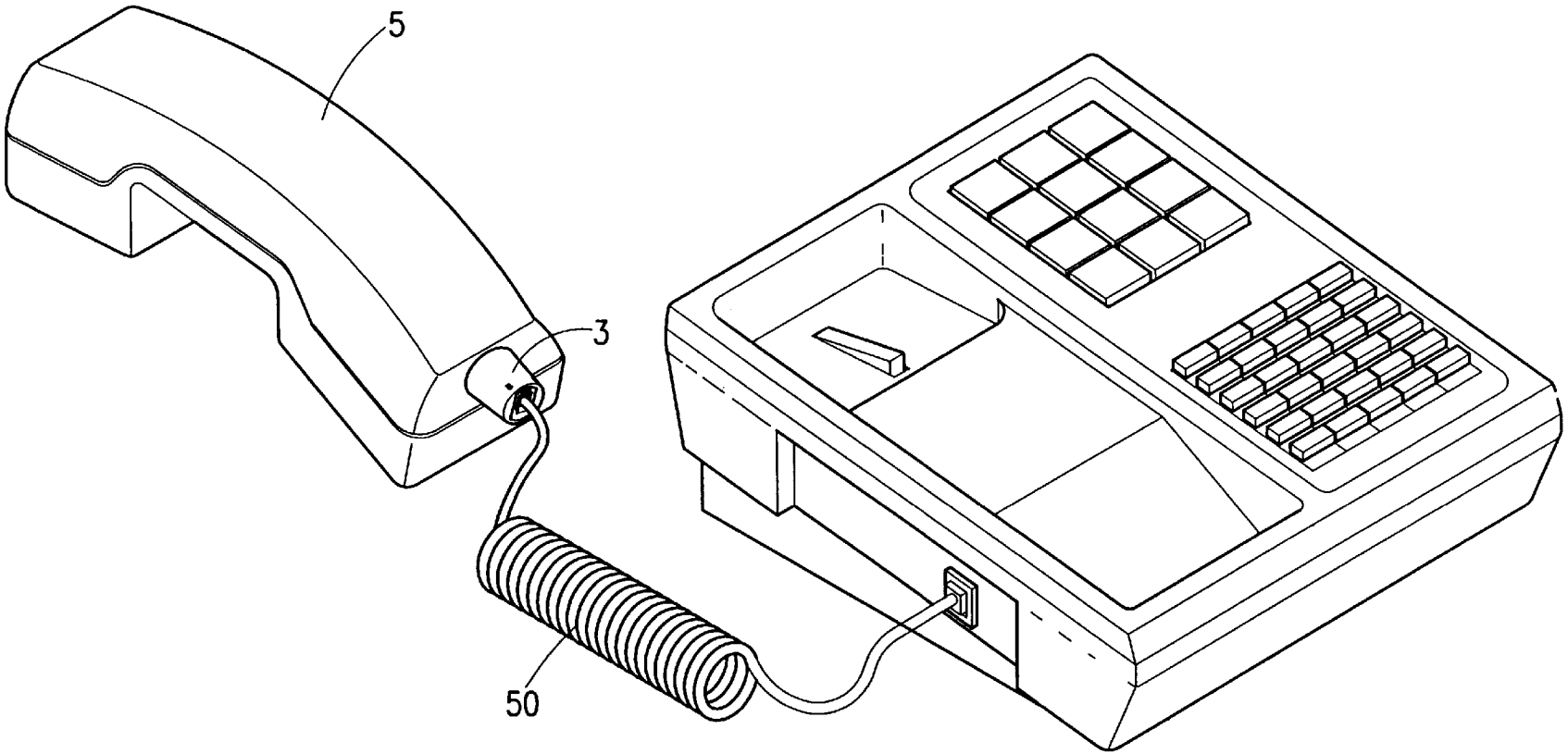
FIG. 4 is a schematic view of the embodiment of the application of the present invention.
Figure 5:
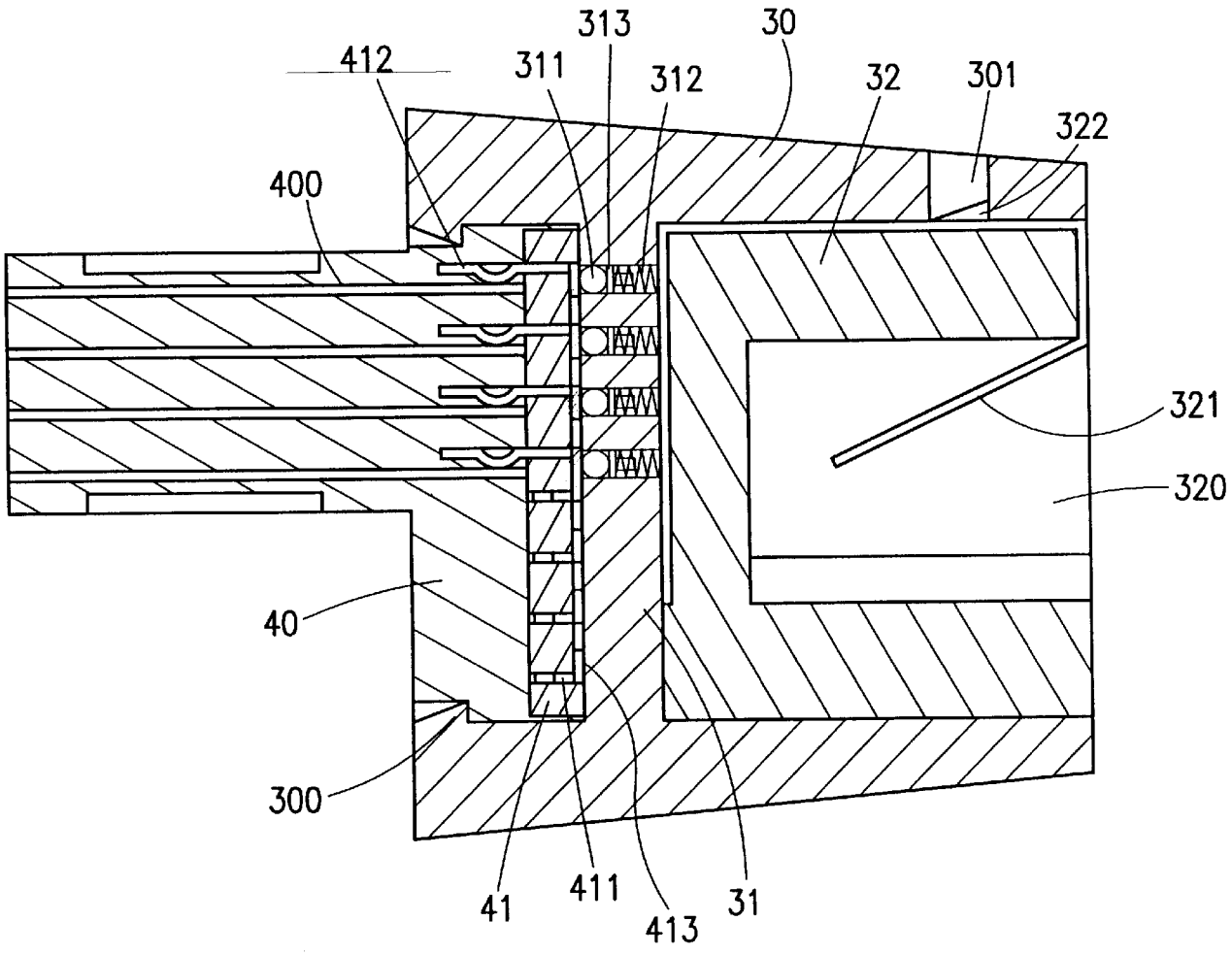
FIG. 5 is a side cross sectional view of one embodiment of the structure of the present invention.
Figure 6:
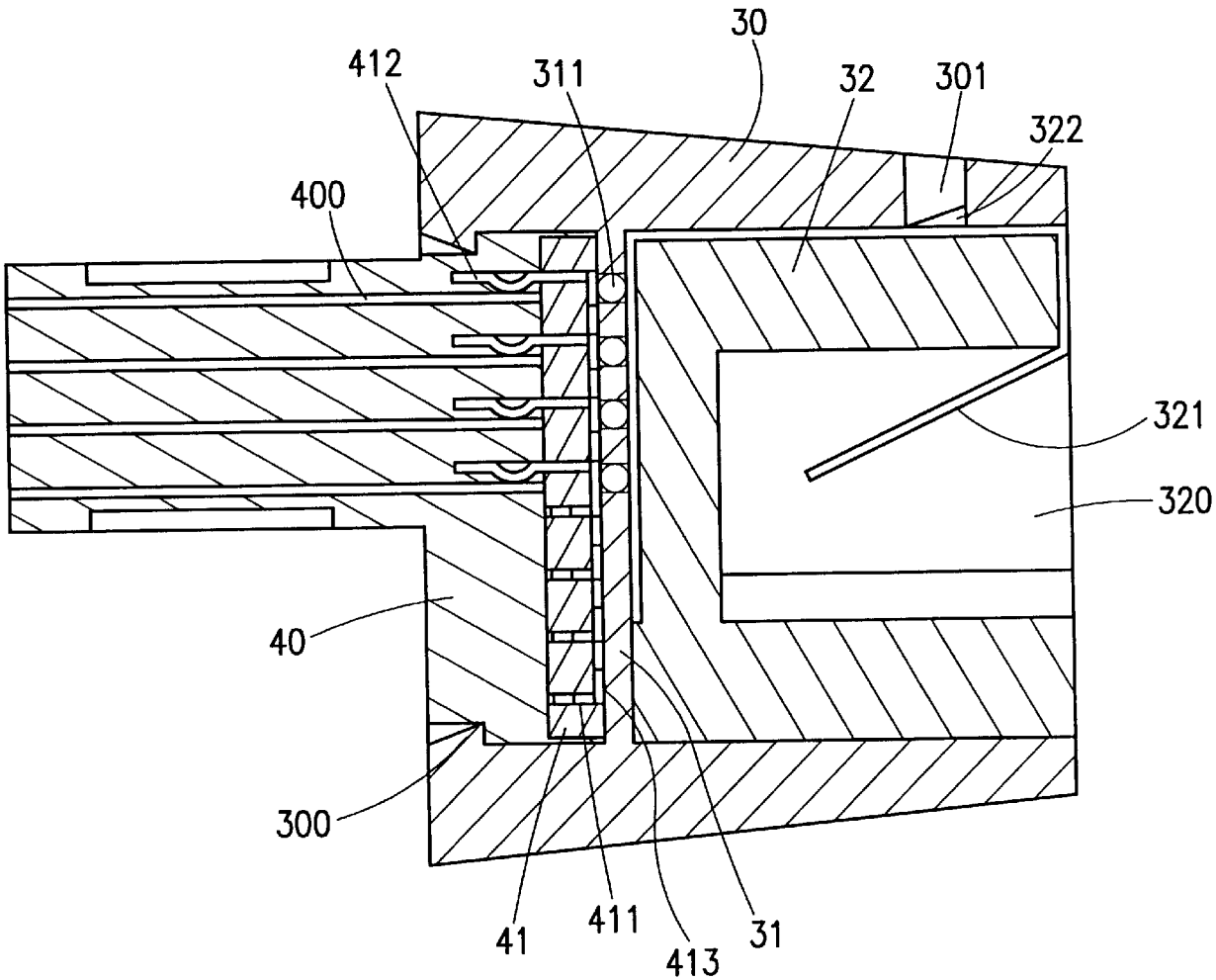
FIG. 6 is a side cross sectional view of another embodiment of the structure of the present invention.

The improvement of the structure of a telephone connector according to the present invention is assembled as shown in FIG. 3. Referring to FIG. 4, the fixing plug 4 is inserted into the receptacle of the telephone receiver 5 or is inserted into the receptacle of a mainframe. Then, the plug 32 of the rotary head 3 receives the plug of the telephone cable 50. Therefore, when the telephone cable 50 is moved and drives the rotary head 3 to rotate with respect to the fixing plug 4, causing the rotary disk 31 to rotate with respect to the round disk 41 of the fixing plug 4. Then, all the rolling balls 311 will roll on the surface of the respective contacting conductive ring 413 along the rotation track. Therefore, an electrically dynamic contact is retained continuously. Since the elastic pieces 412 of the conductive rings 413 are in continuous contact with the contact terminals 400, the continuous contact between the contact terminals 400 and 321 is attained as takes place in the embodiments shown in FIGS. 5 and 6.

It can be appreciated from above description that the rolling balls 311 are freely rotated between the rotary disk 31 and the round disk 41 and between the rotary head 3 and the fixing plug 4, due to the fact that the rolling balls 311 have a round and smooth structure with a lower friction factor and that the friction between the rolling balls and the conductive rings 413 is decreased. Further, if engaging pieces 313 installed between springs 312 and the rolling balls 311 present the direct contact between the springs 312 with the rolling balls 311. Therefore, only points-contact with a lower friction exists between the rolling balls 311 and the engaging pieces 313. Accordingly, the rotary head 3 will rotate more actively. Any intricacy of telephone cables is avoided. Furthermore, the wear of the conductive ring 413 due to the friction of the rolling balls 311 is reduced, and the abnormal vibrations of the parts of the connector are prevented. Accordingly, the structure of telephone connector is stable and is prevented from being destroyed. The communication quality and stability of the signal are also ensured.

In summary, in the improvement of the structure of a telephone connector of the present invention, the rolling balls are used to replace springs, so that defects in the prior art telephone connectors are improved effectively.

Although the present invention has been described using specified embodiment, the examples are meant to be illustrative and not restrictive. It is clear that many other variations would be possible without departing from the basic approach, demonstrated in the present invention. Therefore, all such variations are intended to be embraced within the scope of the invention as defined in the appended claims.

DESCRIPTION OF THE NUMERALS IN FIGURES

| | | | |
|---|---|---|---|
| 1 | Rotary Head | | |
| 10 | Inserting Hole | 11 | Contact Terminal |
| 12 | Through Hole | 13 | Spring |
| 2 | Fixing Plug | | |
| 20 | Plug Body | 200 | Contact Terminal |
| 201 | Pad | 202 | C ring |
| 21 | Round Disk | 210 | Spring |
| 211 | Through Hole | 212 | Conductive ring |
| 3 | Rotary Head | | |
| 30 | Roller | 300 | Stopper |
| 301 | Buckling Hole | 31 | Rotary disk |
| 310 | Through Hole | 311 | Rolling Ball |
| 312 | Spring | 313 | Engaging Piece |
| 32 | Plug | 320 | Inserting Hole |
| 321 | Contact Terminal | 322 | Buckling Block |
| 4 | Fixing Plug | | |
| 40 | Plug Body | 400 | Contact Terminal |
| 41 | Round Disk | 410 | Inserting Hole |
| 411 | Inserting Piece | 412 | Elastic Piece |
| 413 | Conductive Ring | | |
| 5 | Receiver | | |
| 50 | Telephone Cable-- | | |

What is claimed is:

1. A telephone connector, comprising:

(a) a fixing plug having a plug body, said fixing plug including:

a plurality of first contact terminals installed in said plug body in substantially parallel relationship each with respect to the other, a round disk installed in said plug body, said round disk having a plurality of inserting holes formed therein and positioned at predetermined distances from a center of said round disk, and a plurality of conductive rings of different diameters, each said conductive ring having at least one elastic piece formed integrally therewith and insertable into a respective one of said plurality of inserting holes of said round disk, said elastic piece engaging one end of a respective one of said plurality of the first contact terminals, each said conductive ring further having at least one inserting piece extending therefrom for insertion into another respective one of said plurality of inserting holes of said round disk maintaining said conductive rings in a respective predetermined position on said round disk;

(b) a rotary head having a roller body, said fixing plug being rotatably secured within said roller body, said rotary head including:

a rotary disk positioned within said roller body and separating said roller body into first and second compartments, said rotary disk having a plurality of through holes formed therein and positioned a predetermined distance each from the other, a plurality of metal rolling balls, a plurality of springs, one end of each said spring being received in a respective one of said through holes on said rotary disk, and a plurality of engaging pieces, each having a positioning pin and a contact plane, said positioning pin of each said engaging piece being received in a respective one of said springs, and each of said metal rolling balls being in point contact with said plane of a respective one of said engaging pieces; and (c) a plug member secured in said second compartment of said roller body, said plug member having a plurality of second contact terminals secured thereto, each said second contact terminal having one end thereof in contact with a respective one of said springs;

whereby, upon rotation of said roller body, said metal rolling balls respectively maintain rolling contact with said conductive rings, thereby providing an electrical contact between said first and said second contact terminals of the telephone connector.

2. The telephone connector of claim 1, further including at least one buckling block extending outwardly from said plug member and at least one buckling hole formed in an inside surface of said roller member, said plug member being held within said second compartment of said roller body by means of engagement between said at least one buckling block and said at least one buckling hole.

3. The telephone connector of claim 1, further including at least one stopper member formed at an inner surface of said roller body in said first compartment thereof for securing said fixing plug therein by means of engagement between said at least one stopper and said plug body of said fixing plug.

* * * * *